United States Patent [19]

Heng et al.

[11] Patent Number: 5,011,428

[45] Date of Patent: Apr. 30, 1991

[54] TAPPING CONNECTOR FOR A SCREENED ELECTRIC CABLE

[75] Inventors: Jean-Paul Heng; Henri Guernet, both of Lyons; André Marmonier, Bron, all of France

[73] Assignee: Entrelec S. A., Cedex, France

[21] Appl. No.: 507,808

[22] Filed: Apr. 12, 1990

[30] Foreign Application Priority Data

Apr. 14, 1989 [FR] France ..... 89 04970

[51] Int. Cl.[5] ..... H01R 4/24

[52] U.S. Cl. ..... 439/394; 439/578

[58] Field of Search ..... 439/394, 578–585

[56] References Cited

U.S. PATENT DOCUMENTS 3,543,222 11/1970 Rheinfelder ..... 439/394
4,662,067 5/1987 Abraham .
4,701,001 10/1987 Verhoeven .
4,708,414 11/1987 Lam ..... 439/394

*Primary Examiner*—Joseph H. McGlynn
*Attorney, Agent, or Firm*—Sughrue, Mion, Zinn, Macpeak & Seas

[57] ABSTRACT

A tapping connector for a screened multiwire electric cable comprising an outer covering around both a plurality of conductor wires which are electrically insulated from one another and electromagnetic screening forming a sheath around the conductor wires, and optionally around a drain conductor providing electrical continuity for the screening. An annular portion of the outer covering and at least a portion of the sheath forming the screen being removed from a selected position along the cable for installation of the connector. The connector comprises at least two complementary portions which are dissociable to allow a cable to be put into a position passing between them and to enable the cable to be held stationary relative thereto when they are reassembled. The connector further includes a plurality of parallel grooves on one of its portions, each groove containing either an insulation-piercing connection piece for making electrical connection with a corresponding one of the insulated conductor wires or with a drain conductor, or else a conducting connection piece constituting a tab for making contact with a drain conductor or a conducting link providing screening continuity.

3 Claims, 2 Drawing Sheets

1
2
3
4A
4A1
4B
5
6
7
8
9
10
11
12
15
17
18
19
21
22
23A

TAPPING CONNECTOR FOR A SCREENED ELECTRIC CABLE

The invention relates to a tapping connector for use with an electromagnetically screened multiwire electric cable, and intended more particularly for use with low-current installations, e.g. local networks having a multiplicity of stations where the various stations are connected in parallel along a single cable for the purpose of interchanging data.

BACKGROUND OF THE INVENTION

Insofar as the environments in which cables are situated are subject to electromagnetic interference, or may be subject thereto, it is conventional practice to prefer screened cables to un-protected cables in order to prevent the stations both for transmitting and from receiving interference signals by the antenna effect due to the cable.

The electromagnetic screening of the cable is generally constituted by an electrically conductive sheath which surrounds the conductor wires used for transmitting data and which is in turn covered with a single layer or multi-layer protective covering.

Assuming that an end connection is not desired, and in particular when a plurality of stations are to be connected in parallel to a common cable link, it is necessary to provide openings through the protective covering and through the screening in order to connect external equipment to the transmission conductor wires of a cable.

The invention therefore seeks to provide a tapping connector which requires a minimum amount of cable preparation at the tapping point and which is easy to make and to install on a screened multiwire electric cable of the type comprising an outer single layer or multi-layer protective covering, surrounding both a plurality of conductor wires which are electrically insulated from one another and electromagnetic screening constituting a sheath for said conductor wires, and optionally also surrounding at least one electrical continuity drain conductor for the screening.

SUMMARY OF THE INVENTION

The tapping connector is intended to be installed at a selected location along the cable where an annular portion of the outer covering and at least a portion of the sheath constituted by the screening at said location have been removed. The connector comprises two portions which are complementary and dissociable, enabling the cable to be held and positioned where it passes between them in a zone where said cable is held stationary when the two portions are connected together. A plurality of parallel grooves carried by one of the two portions are open at both ends and to the side facing the zone where the two portions meet, with a groove being provided to receive each of the insulated conducting wires and a drain or other conductor ensuring electrical continuity of the screening through said location. Pushers carried by the other portion are suitable for penetrating into respective ones of the grooves when the portions are assembled together in order to hold clamp the corresponding conductor wires and a drain or other conductive link therein and put each of them into electrical contact with a corresponding connector piece projecting into the groove.

BRIEF DESCRIPTION OF THE DRAWINGS

An embodiment of the invention is described by way of example with reference to the accompanying drawings, in which.

DETAILED DESCRIPTION

Figures 1, 2, 3:
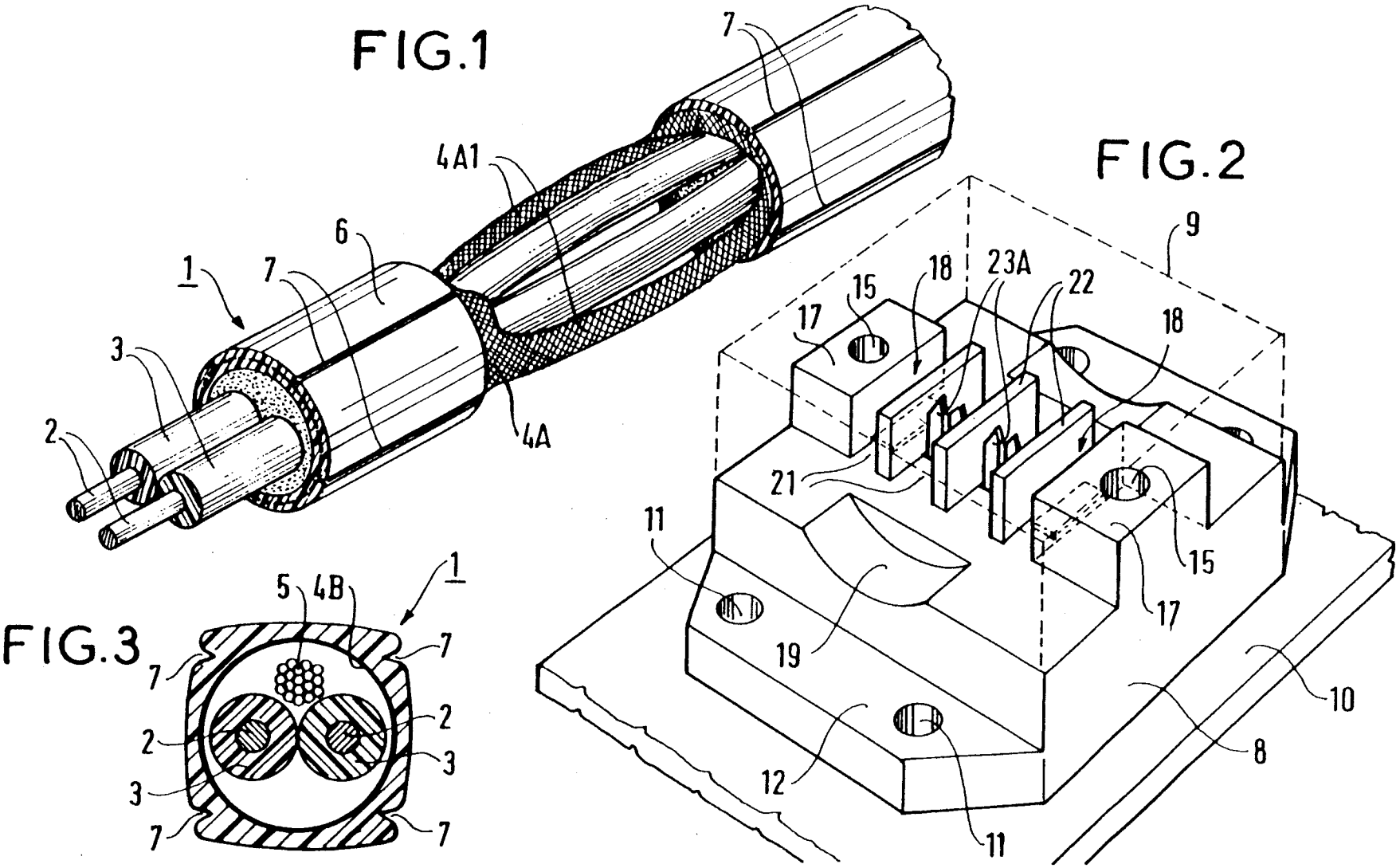
FIG. 1 shows an example of a screened multiwire cable prepared for installing on a tapping connector.
FIG. 2 shows an example of a tapping connector for a screened multiwire cable.
FIG. 3 is a cross-section through a variant of the cable.
Figure 4:
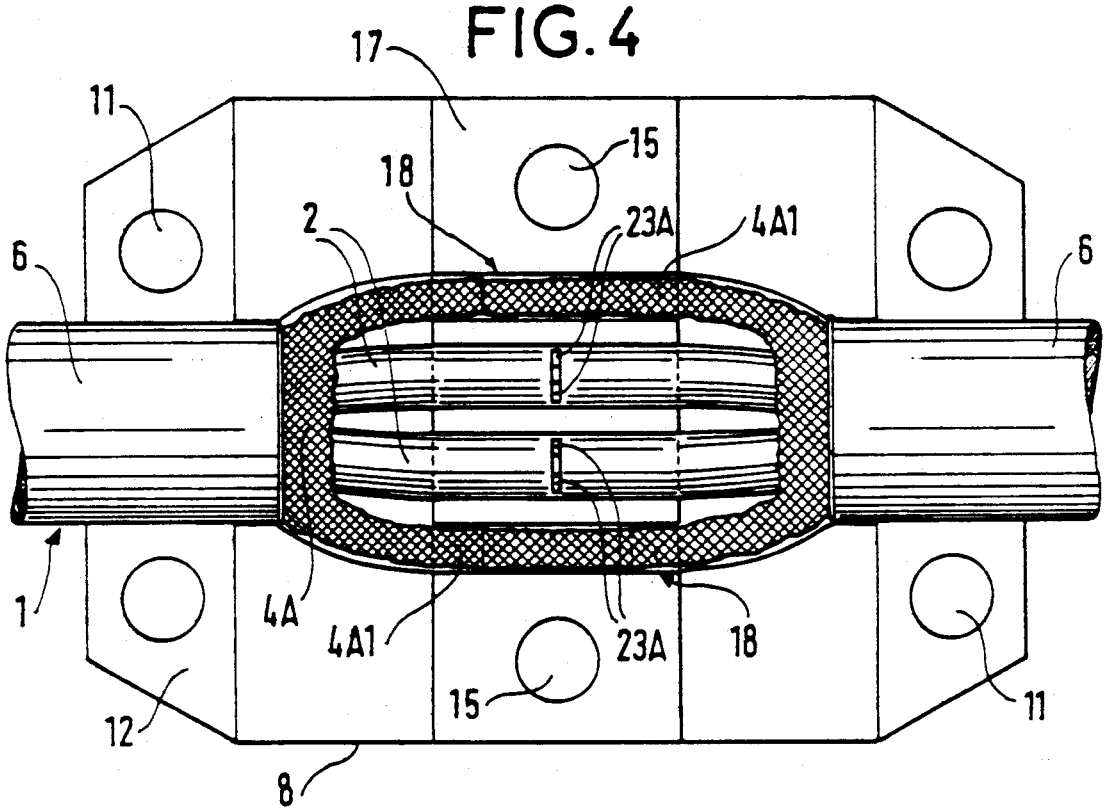
FIG. 4 is a plan view of the connector base showing the cable in place.

The tapping connector of the invention is intended to be installed on a screened multiwire cable, in particular a cable 1 as shown in one or other of FIGS. 1 and 3. Such a cable 1 has a plurality of conductor wires 2, in this case two such wires, each covered with its own insulating covering 3. These wires are received inside electromagnetic screening 4 constituted, for example, by means of fine conductor wires generally disposed obliquely relative to the conductor wires 2 which they surround, thereby forming a sheath such as 4A. Alternatively, the electromagnetic screening may be provided in the form of a fine conducting strip 4B disposed helically around the assembly constituted by the conductor wires 2, in which case the screening is associated with at least one drain conductor 5 constituted in this case by a multistrand wire disposed along the conductor wires 2 which are covered in insulation, and which makes electrical contact with the conducting strip 4B inside the screening sheath constituted around the insulated conductor wires 2 by said strip, as shown in FIG. 3. It is also possible to include a drain conductor inside a sheath made of metal wires.

In any event, the electromagnetic screening is generally covered with a covering 6 comprising at least one insulating layer.

For connection with a connector at an arbitrary location along the cable 1, the cable needs to be opened locally at the location where the connector is to be installed so as to give access to the conductor wires 2 and to the electromagnetic screening constituted by the sheath 4A or the drain conductor 5.

The cable is opened by locally removing an annular portion of the covering 6 surrounding the electromagnetic screening 4A or 4B, and also at least a portion of this screening in that zone of the cable from which the insulating covering has been removed.

If the cable is of the type shown in FIG. 3, the conducting strip 4B is removed from the zone of the cable where it is laid bare. Electrical continuity between the portions of conducting strip 4B situated on either side of the portion of cable from which the conducting strip has been removed is then provided by the drain conductor 5.

Alternatively, if the electromagnetic screening is constituted by a sheath of fine metal wires 4A, then the sheath may be cut by means of a cutting tool (not shown) in that zone of the cable which is to receive the connector. In the example shown in FIG. 1, two diametrically opposite cuts are made, thereby leaving two conductive links 4A1 ensuring electrical continuity of the screening while allowing free access to the conductor wires 2.

With either embodiment of the cable, removal of the electromagnetic screening at the location which is to receive the connector is facilitated by providing reference means for the cutting tool, e.g. longitudinal groves 7 suitable for engaging the cutting jaws of a pincer type tool at predetermined positions on either side of the axis of the cable, thereby enabling the covering to be stripped and the screening to be cut simultaneously in one or two operations.

The tapping connector of the invention is intended to connect a cable 1 prepared in this way to electrical equipment (not shown), and it is designed to be installed at a prepared location at an arbitrary point along the cable 1 which cable may itself be permanently installed so that the connector is at least partially dissociable into two complementary portions 8 and 9 designed to be placed on opposite sides of the cable.

In the embodiment shown, the portion 8 is arranged to constitute a base enabling the connector to be fixed on a flat support 10, in particular a printed circuit card, either before or after the connector has been connected to a cable.

Such connections to a support may be performed, for example, by riveting or by a nut and bolt system passing through fixing holes 11 made through flanges 12 the base-forming portion 8. In this case, the two portions 8 and 9 are made of insulating material, e.g. molded material, and they engage each other in a predetermined manner, optionally holding stationary a cable 1 therebetween, said cable being duly prepared as described above in a zone intended for connection to the connector.

Figure 5:
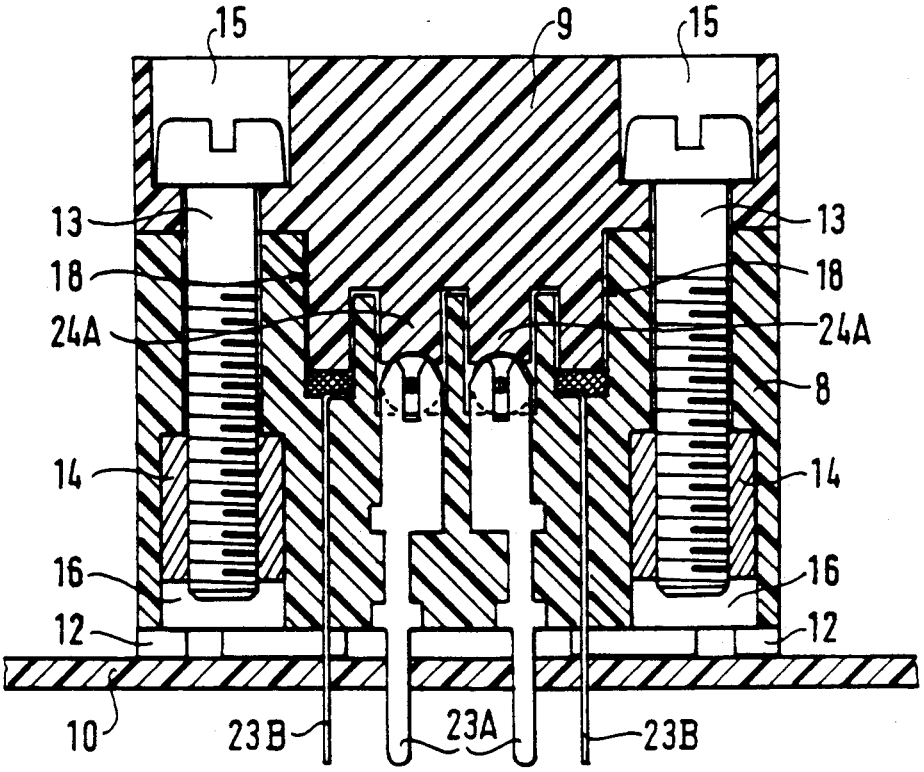
FIG. 5 is a central cross-section through an assembled connector.

The additional clamp-forming portion 9 is fixed on the complementary base-forming portion 8 by means of nuts 14 and bolts 13 (see FIG. 5). The heads of the bolts are accessible from outside the assembled connector whether or not it is mounted on a support 10, and to this end the heads bear against ducts 15 going through the complementary portion 9 and opening out from the connector at its side opposite to the flanges 12. The nuts 14 are accessible in this case from outside the connector prior to the connector being mounted on the support 10, and they are received in and prevented from rotating by ducts 16 against which they bear when tightened. The ducts 16 pass right through the portion 8 on either side of the path between the portions 8 and 9 provided for the cable to be connected, said ducts extending inside studs 17 upstanding on the portion 8 on either side of the cable path and serving to receive the bolts 13.

The portion 9 is properly positioned on the portion 8 by the studs 17 co-operating with housings of complementary shape provided in the portion 9. The facing walls 18 of the two studs lie parallel to the cable path and serve to guide displacement in translation of a pusher block 20 on the portion 9 during the fixing and connection operations. Both fixing and connection are obtained by forcing the portion 9 along a direction defined by the axes of the ducts 15 and 16 when the bolts 13 are tightened. The length of the portion of the cable from which an annular portion of its outer covering is stripped for connection purposes is selected in such a manner as to ensure that the ends of the remaining portions of the covering that subsist after the portion that interconnected them has been removed, are received in complementary notches 19 formed in the portions 8 and 9 between which these portions of covering are held stationary when the connector portions 8 and 9 are screwed together.

Parallel grooves 21 are provided between the walls 18 of the studs 15 with each groove being intended to receive either a drain 5, or a conducting link portion 4A1 of the screening, or else an insulated conductor 2. To this end, small parallel partitions 22 project from the complementary portion 8 between the studs 15 and extend parallel to the walls 18 so as to form grooves which are open at both ends and also along the side facing the zone where the portions 8 and 9 meet.

This makes it possible to take the conductor wires 2, a drain 5, or the conducting links 4A1 taken from the zone of the cable 1 where these conducting items have been bared and between two zones where they have not been bared, and to install them sideways into respective ones of the grooves.

Conducting connector pieces 23 are provided in each of the grooves for establishing electrical continuity by contact between the equipment (not shown) served by the connector and respective ones of the conducting wires, and a drain or the conducting links.

Each of these conducting pieces 23 projects into one of the grooves 21 and also from the support-engaging surface of the base portion 8.

The conducting pieces 23 project from the base in the form of connection pins suitable for directly connecting the connector to a circuit formed on the support 10. The support may be constituted, for example, by a printed circuit card included in the equipment to be served and in conventional manner the connection pins are either plugged through or pressed against conducting tracks on the card.

The conducting pieces 23 project into the grooves in the form, for example, of individual projections having insulation-piercing connection slits, as shown for the pieces referenced 23A in FIGS. 2 and 5, said slits being intended to make connection with the conductor wires 2 having individual insulation 3, and optionally also with a drain conductor 5, in which case a suitable connector piece 23A is provided for the drain in one of the grooves 21. Individual pushers 24A project from the pusher block 20 and co-operate in conventional manner with a flared extension of each insulation-piercing connection slit in each of the grooves for ensuring electrical connection with the conductor wires 2 when the two portions 8 and 9 are pressed against each other by tightening the bolts 13.

The connection pieces 23 may alternatively project into the grooves in the form of projecting tabs as shown for the connection pieces 23b of FIG. 5, with each tab being suitable for making connection with a drain conductor 5 or with a conducting link 4A1. Each drain or conducting link is pressed against a tab in one of the grooves by a corresponding individual pusher 24B projecting from the pusher block 20 in parallel with the individual pushers 24A. In conventional manner, each of these various pushers has a thrust end shaped in a manner appropriate to the use to which it is put.

The number of grooves 21 and their respective functions are naturally selected as a function on the number of insulated conductor wires 2, the number of drains 5, and/or the number of conducting links 4A1 with which connections are to be made.

The shapes of the connection pins situated beneath the base may also be suitable for making contact with complementary connection members in a conventional pluggable connector which plugs onto these pins in the usual manner.

The connector constituted by the portions 8 and 9 may itself be electromagnetically screened in order to ensure screening continuity for the cable on which it is installed. This may be obtained by metallization of the surfaces of insulating material constituting the portions 8 and 9, e.g in zones situated on the outside of the assembled connector, and by putting said zones into electrical connection by contact with the screening of the cable, e.g. via one of the connection pins of the connection pieces 23B.

We claim:

1. A tapping connector for a screened multiwire electric cable comprising an outer covering around both a plurality of conductor wires which are electrically insulated from one another and electromagnetic screening forming a sheath around said conductor wires, and optionally around a drain conductor providing electrical continuity for the screening, an annular portion of the outer covering and at least a portion of the sheath forming the screen being removed from a selected position along the cable for receiving the connector, wherein the connector comprises at least two complementary portions which are separable to allow a cable to be put into a position passing between them and to enable the cable to be held stationary relative thereto when they are reassembled, the connector including a plurality of laterally spaced, parallel grooves on one face of one of said portions, which grooves are open at both ends and to the side facing a zone where the two portions meet, at least one of said grooves containing an insulation-piercing connection piece for making electrical connection with a corresponding one of the insulated conductor wires or with a drain conductor, and at least one other of said grooves containing a conducting connection piece constituting a tab for making contact with a drain conductor or a conducting link providing screening continuity, the other portion of the connector having laterally spaced male pushers penetrating into respective ones of the grooves for causing a drain conductor or a conducting link or a conductor wire to be held stationary in each groove and for causing electrical connection to be made therewith when the connector portions are pressed against each other.

2. A tapping connector according to claim 1, wherein the grooves are provided in one of said two portions which constitutes a base for the connector and which has the connection pieces passing therethrough and projecting both beneath the base in the form of connection pins and into respective ones of the grooves either in the form of insulation-piercing connection slits or else in the form of tabs for making electrical connection by thrust contact.

3. A tapping connector according to claim 1 and including a metal screening layer electrically connected to the screening of the cable and ensuring continuity of screening in the zone where the cable is opened.

* * * * *